US008650792B1

(12) United States Patent
Overmars

(10) Patent No.: US 8,650,792 B1
(45) Date of Patent: Feb. 18, 2014

(54) GUN MAGAZINE LOADER

(75) Inventor: Ben J. A. Overmars, Fife, WA (US)

(73) Assignee: Ben's Outdoor Design, Inc., Tacoma, WA (US)

( * ) Notice: Subject to any disclaimer, the term of this patent is extended or adjusted under 35 U.S.C. 154(b) by 0 days.

(21) Appl. No.: 13/542,573

(22) Filed: Jul. 5, 2012

Related U.S. Application Data

(60) Provisional application No. 61/504,448, filed on Jul. 5, 2011.

(51) Int. Cl.
*F41A 9/83* (2006.01)

(52) U.S. Cl.
USPC ..... 42/87

(58) Field of Classification Search
USPC ..... 42/87; 89/33.01; 86/45, 46; 7/112; 294/55.5, 57, 59; 473/408; 30/147, 30/148, 150, 322, 323
See application file for complete search history.

(56) References Cited

U.S. PATENT DOCUMENTS

| | | | | | |
|---|---|---|---|---|---|
| 73,331 | A | * | 1/1868 | Holly | 294/23.5 |
| 234,855 | A | * | 11/1880 | Daniels | 30/322 |
| 275,130 | A | * | 4/1883 | Brown | 294/55.5 |
| D24,534 | S | * | 8/1895 | Hirsch | D7/663 |
| 1,227,920 | A | * | 5/1917 | Maaske | 220/759 |
| 1,594,314 | A | * | 7/1926 | Mincer | 30/129 |
| 1,769,471 | A | * | 7/1930 | Smith | 30/322 |
| 1,801,084 | A | * | 4/1931 | Huie | 30/129 |
| 2,466,017 | A | * | 4/1949 | Farber | 42/72 |
| 2,870,561 | A | * | 1/1959 | Colby | 42/18 |
| 2,887,811 | A | * | 5/1959 | Johnson, Jr. | 42/87 |
| 3,049,182 | A | * | 8/1962 | Pelow | 172/378 |
| 3,373,520 | A | * | 3/1968 | Into | 42/49.01 |
| 3,539,017 | A | * | 11/1970 | Johnson | 172/378 |
| 3,760,501 | A | * | 9/1973 | Johnston | 30/322 |
| D264,169 | S | * | 5/1982 | Guttman | D7/690 |
| D282,898 | S | * | 3/1986 | Furlan | D7/690 |
| 4,627,621 | A | * | 12/1986 | Tate | 473/286 |
| 5,417,003 | A | * | 5/1995 | Claveau | 42/90 |
| 5,752,285 | A | * | 5/1998 | Bendheim et al. | 7/167 |
| D482,937 | S | * | 12/2003 | Renault | D7/683 |
| 2004/0123469 | A1 | * | 7/2004 | Wilkinson et al. | 30/137 |
| 2010/0266997 | A1 | * | 10/2010 | Lombard et al. | 434/236 |

* cited by examiner

*Primary Examiner* — Bret Hayes
(74) *Attorney, Agent, or Firm* — Wolfe-SBMC

(57) ABSTRACT

A loader for gun magazines. The loader includes a handle and a pair of spaced apart, outwardly extending prongs. In an embodiment, a stiffener is used to maintain alignment of prongs, and to keep the prongs from being urged apart during use. The loader is used by engaging prongs with a cartridge in the magazine, and then urging the cartridge against biasing means to create space for a cartridge to be loaded. Once space is created, the cartridge to be loaded is urged into magazine while cradled between prongs of the loader.

21 Claims, 5 Drawing Sheets

GUN MAGAZINE LOADER

RELATED PATENT APPLICATIONS

This application claims priority from U.S. Provisional Patent Application Ser. No. 61/504,448 filed on Jul. 5, 2011, entitled GUN MAGAZINE LOADER, the disclosure of which is incorporated herein in its entirety, including the specification, drawing, and claims, by this reference.

COPYRIGHT RIGHTS IN THE DRAWING

A portion of the disclosure of this patent document contains material that is subject to copyright protection. The applicant has no objection to the facsimile reproduction by anyone of the patent document or the patent disclosure, as it appears in the Patent and Trademark Office patent file or records, but otherwise reserves all copyright rights whatsoever.

TECHNICAL FIELD

This application relates to firearms, and more particularly, to an apparatus for loading cartridges into reloadable magazines, as often used in semi-automatic or automatic weapons.

BACKGROUND

A wide variety of firearms are available with detachable magazines. Such magazines may be loaded with a plurality of cartridges, which in many currently available designs are urged toward a magazine exit by a spring biasing mechanism. Such magazines enable selected number of individual cartridges to be accessible for manual, automatic, or semi-automatic firing, according to a specific firearm design. Currently, in so far as I am aware, the available tools for magazine loading are rather cumbersome. Thus, there remains a need to provide a simple tool for use in depressing a cartridge in a clip, or depressing the base of a biasing mechanism in the clip, to quickly and easily reload cartridges into a magazine. It would be desirable to provide a suitable tool that would enable individuals to quickly and easily reload cartridges into a magazine after cartridges in the magazine have been discharged from the firearm.

SUMMARY

A novel gun magazine loader has been developed, that, in various embodiments, greatly eases the task of reloading cartridges into magazines. In an embodiment, the loader includes a handle and a pair of stiff, spaced apart, outwardly extending prongs. In an embodiment, the prongs may be provided with a curved upper interface surface that may easily cradle a cartridge which is next in line for loading into a magazine. In an embodiment, a cartridge accepting cradle portion may be formed in the handle. In an embodiment, the prongs may be provided with a curved lower interface surface that may easily apply force to a cartridges or clip base, to urge such cartridges or clip base downward against a spring biasing means in the clip. In an embodiment, the prongs may be provided using first and second prongs that are cylindrical in shape, whereby the curved upper interface surface and the curved lower interface surface are determined by the diameter of the cylindrical prongs.

In a method of use of the magazine loader, cartridges to be loaded may be placed on upper interface surfaces of the outwardly extending prongs, and cradled between prongs. In a method of use of an embodiment of the magazine loader, cartridges to be loaded may be first placed in a cradle portion of the handle. In one method of use, a user may steady the cartridge to be loaded in such a cradled position, whether on the handle or on the prongs, with a thumb. The user then can use the lower interface surface of the outwardly extending prongs to press a cartridge already in a clip, or the clip base in a totally unloaded clip, downward, to make space for the cartridge to be loaded. Once space has been created by urging the prongs downward against the cartridge already in the clip, the cartridge to be loaded may be slid into the clip, along the upper interface surface of the outwardly extending prongs. Once the cartridge is safely located, downward pressure may be released, and the just loaded cartridge secured by the upper end of the clip. Then the prongs of the magazine loader are removed from the clip. The process may be repeated until the magazine has full complement of cartridges.

BRIEF DESCRIPTION OF THE DRAWING

A novel magazine loader will be described by way of exemplary embodiments, using for illustration the accompanying drawing in which like reference numerals denote like elements, and in which.

Figure 1:
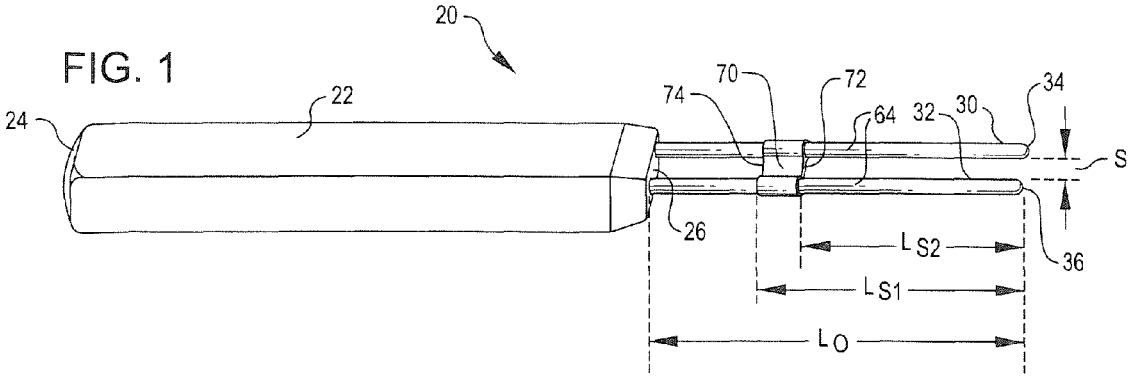
FIG. 1 is a perspective view of an embodiment for a magazine loader, in which a pair of spaced apart, outwardly extending prongs is illustrated.

The foregoing figures, being merely exemplary, contain various elements that may be present or omitted from firearm magazine loader designs utilizing the principles taught herein, or that may be implemented in various embodiments for such magazine loaders. Other variations in prong designs or in handle designs may use slightly different mechanical structures, or different mechanical strengthing arrangements, or prong upper or lower surface shapes, yet employ the principles described herein or depicted in the drawing figures provided. An attempt has been made to show the figures in a way that illustrates at least those elements that are significant for an understanding of an exemplary firearm magazine loader design. Such details should be useful for providing a magazine loader, and for facilitating a quick and easy method for loading gun magazines.

It should be understood that various features may be utilized in accord with the teachings hereof, as may be useful in different embodiments as necessary or useful for various sizes and shapes of cartridges and magazines, depending upon the conditions of service, resistance of springs, and other variables, yet be provided within the scope and coverage of the teachings herein as defined by the claims.

DETAILED DESCRIPTION

Attention is directed to FIG. 1, where an embodiment for a gun magazine loader 20 is provided. The loader 20 includes a handle 22 with first end 24 and second end 26. In this embodiment, spaced apart first prong 30 and second prong 32 extend outwardly from the second end 26 of handle 22 to first 34 and second 36 distal ends, respectively. As seen in FIGS. 3, 4, 5, and 6, the first prong 30 and second prong 32 are sized and shaped for engaging and cradling therein a cartridge 40 that is to be loaded in a magazine 42 (see FIG. 5). In one suitable embodiment, first prong 30 and second prong 32 are provided in the form of a pair of strong, tempered steel rods. In an embodiment, first prong 30 and second prong 32 may be provided using stiff cylindrical steel rods having a diameter D (see FIG. 2) of about 3/32" (0.094 inches). Generally, it is desirable that the first 30 and second 32 prongs are sufficiently stiff to resist bending when urged against a cartridge 46 held in the magazine 42 by a biasing device (see spring 47 in FIG. 11) of the magazine 42. Such just described embodiment may be provided in a configuration capable of loading cartridges of various calibers, for example from about 45 caliber down to about 25 caliber, or slightly smaller, without additional parts or accessories.

Figure 2:
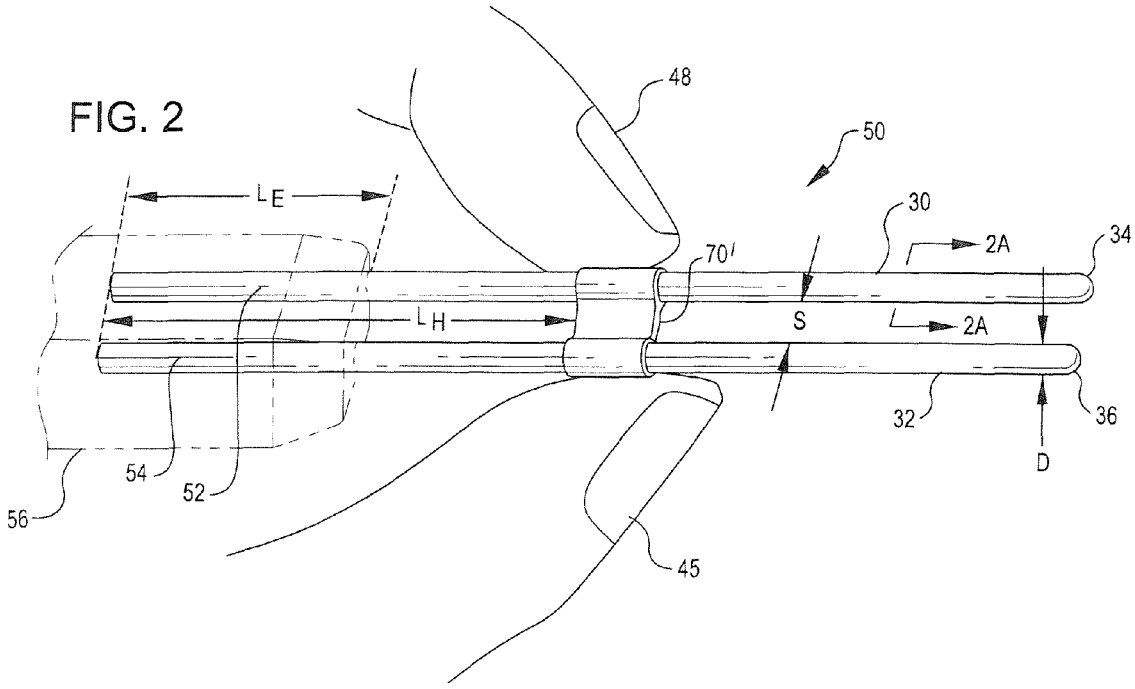
FIG. 2 is a perspective view of an embodiment for a pair of outwardly prongs useful for a magazine loader, but shown without a handle.

As better seen in FIG. 2, between a thumb 45 and finger 48, a working end 50 for a loader 20 is provided. The working end 50 includes the prongs 30 and 32 as just described. The working end 50 may also include at least one prong base, and as shown a first prong base 52 and a second prong base 54. As indicated by broken lines, a handle 56 may have embedded therein, such as by use of a molded plastic handle the first prong base 52 and the second prong base 54.

Figure 2A:
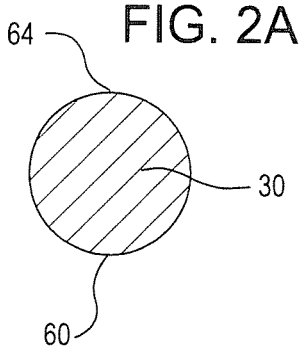
FIG. 2A provides a cross section of an exemplary prong, taken as along section line 2A-2A of FIG. 2, showing an embodiment for an upper engaging surface shape and for the lower engaging surface shape.
Figure 3:
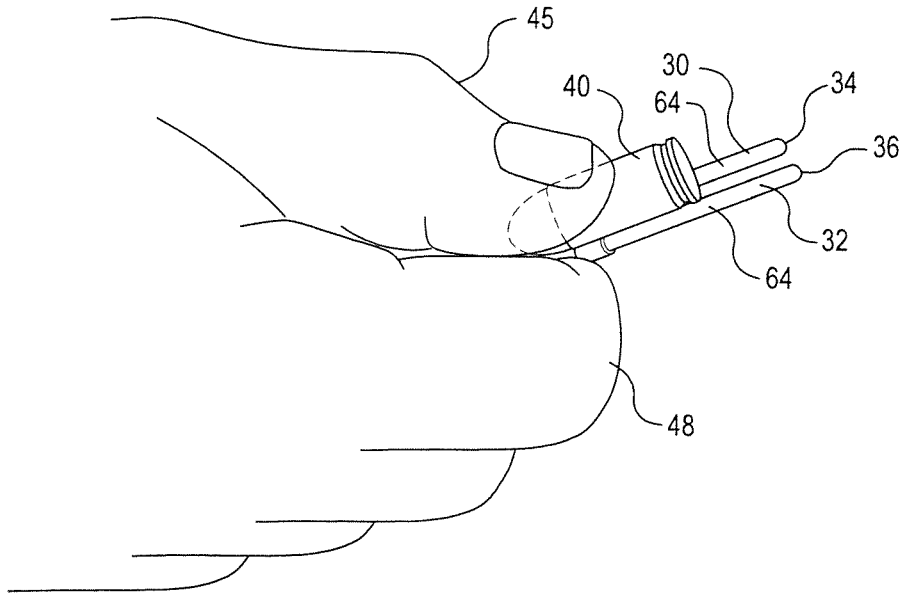
FIG. 3 is a perspective view of a user securing a cartridge to be loaded by using his thumb on the cartridges, before engagement with a magazine loader.
Figure 4:
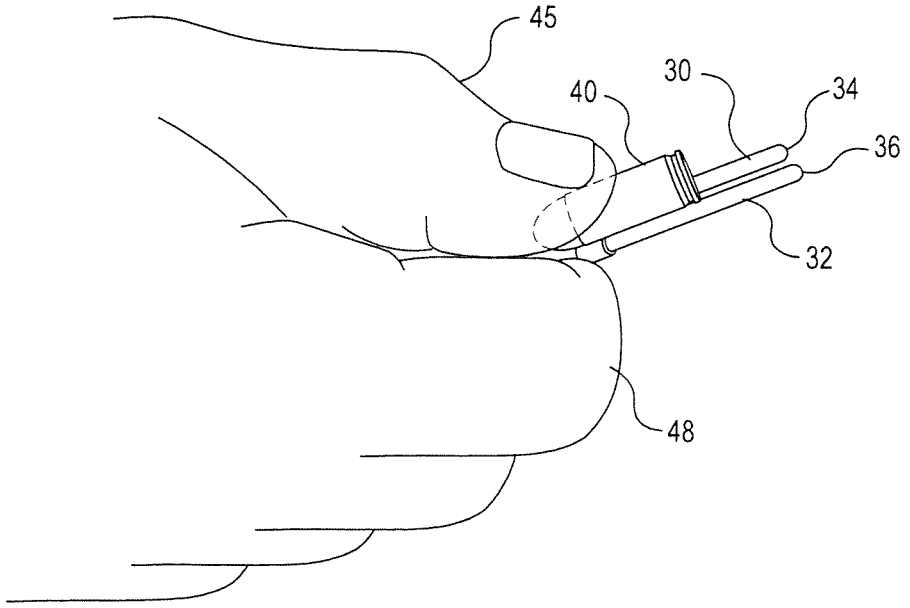
FIG. 4 is a perspective view of a portion of a user's hand, similar to FIG. 3 above, further illustrating how a cartridge to be loaded may be securely engaged on upper engaging surfaces between a pair of outwardly extending prongs.

FIG. 2A shows a cross-sectional view of first prong 30, which may be considered typical for many embodiments, for both first prong 30 and second prong 32. Either or both prongs 30 and/or 32 may include curved lower engaging surfaces 60 for engaging and biasing a cartridge 46 held in a magazine 42 away from an upper open end 62 of the magazine 42. In an embodiment, the prongs 30 and/or 42 may be generally cylindrical, i.e. round in cross-section. Also, either or both of prongs 30 and/or 32 may include curved upper engaging surfaces 64 for engaging, accepting and cradling a cartridge 40 to be loaded in the magazine 42. In an embodiment, the upper engaging surfaces may be provided by prongs 30 and/or 42 that may be generally cylindrical, i.e. round in cross-section.

Figure 1A:
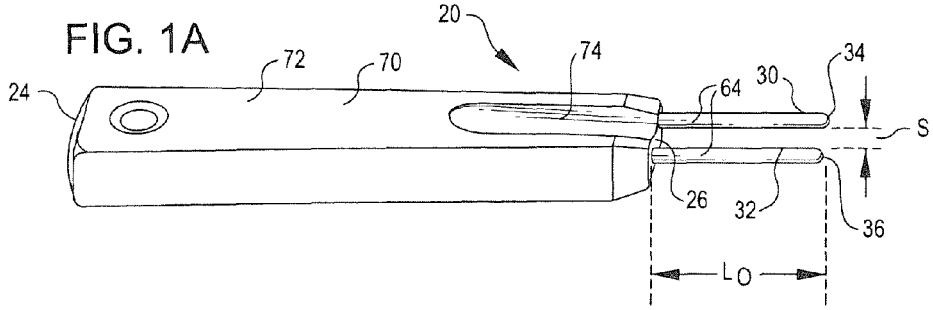
FIG. 1A is an obverse view of an embodiment for a magazine loader, in which are pair of short, spaced apart, outwardly extending prongs are illustrated, and in which a groove is provided for providing an initial position for setting a cartridge to be loaded.

As seen in FIG. 1, a stiffener 70 may be optionally provided secured to and between the first 30 and second 32 prongs. In various embodiments, the stiffener 70 may be spaced apart from the handle 22, to increase its effectiveness in maintaining the spacing S between first 30 and second 32 prongs. In various embodiments, the first 30 and second 32 prongs may have an exposed overall length $L_O$ of about two (2) inches. In various embodiments, such as shown in FIG. 1A, the first 30 and second 32 prongs may have an overall exposed length $L_O$ of about one (1) inch. As seen in FIG. 2, first 30 and second 32 prongs may be provided with an embedded length $L_E$ located in a handle, such as handle 56. For various embodiments, an embedded length $L_E$ of about ¾ inch, or more, may be satisfactory. Returning now to FIG. 1, in an embodiment the outer end 72 of the stiffener 70 may be spaced apart from the distal ends 34 and 36 by a length $L_{S1}$. For various cartridge sizes, a length $L_{S2}$ of about one and one-quarter (1.25) inches has been found workable. In an embodiment, the stiffener 70 has an inner end 74, and the inner end 74 is spaced apart from the distal ends 34 and 36 by a length $L_{S1}$. For various cartridge sizes, and stiffening requirements, a length $L_{S1}$ of about one and one-half (1.5) inches has been found workable. Thus, in such an embodiment, the stiffener 70 has a width of about one-quarter (0.25) inches. As noted in FIG. 2, for various embodiments, and stiffening requirements, a length $L_H$ of about one inch, or about one and one-half (1.5) inches, or more, has been found workable.

Figure 8:
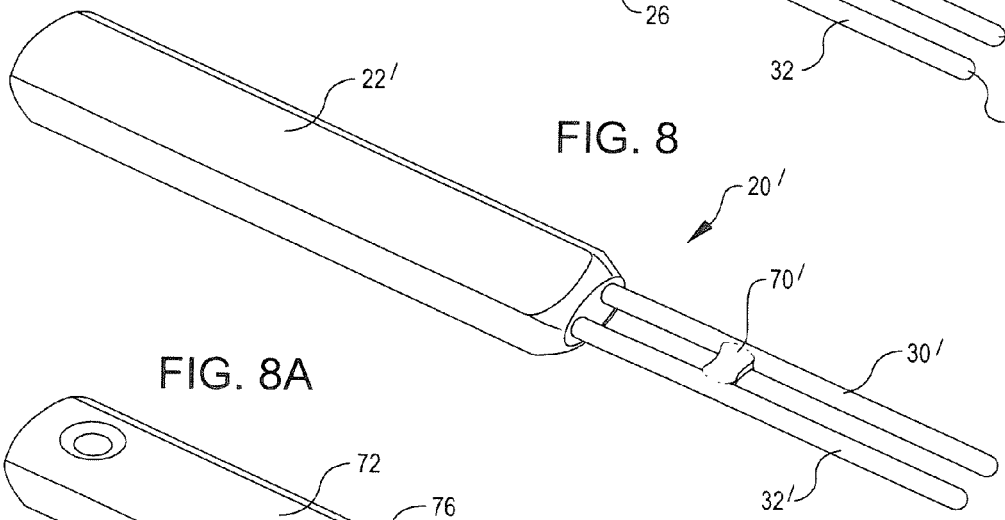
FIG. 8 is a perspective view of another embodiment for a magazine loader, showing a pair of outwardly extending prongs, and the use of a welded or brazed type stiffening member joining the prongs.

Turning now to FIG. 8, another embodiment for a loader 20' is shown. In this embodiment, a handle 22' is provided, and first prong 30' and second prong 32' are provided extending outwardly therefrom, with general construction details for such loaders 22' as described above. In an embodiment, a stiffener 70' may be mechanically and/or metallurgically joined, such as by welding or brazing, to prongs 30' and 32'.

Figure 9:
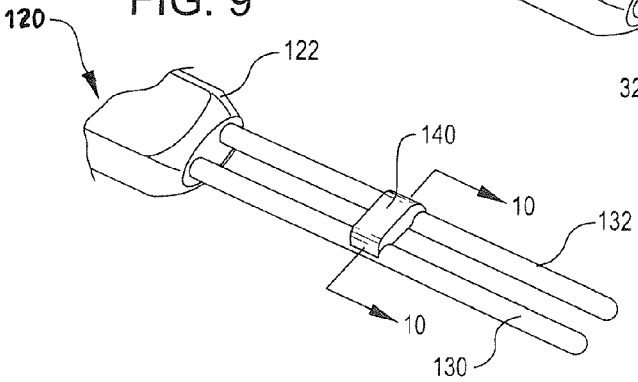
FIG. 9 is a reverse side perspective view of an embodiment for a magazine loader, showing the use of a spot welded bridge for strengthening the device, and for maintaining spacing between the outwardly extending prongs.
Figure 10:
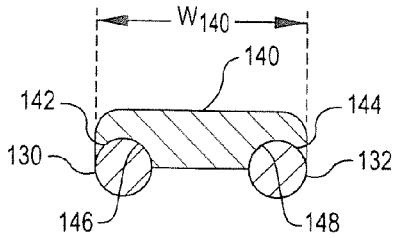
FIG. 10 is a cross-sectional view, taken across line 10-10 of FIG. 9, showing the configuration of a spot welded bridge as may be placed on the reverse, or underside, of a set of outwardly extending prongs.

Attention is directed to FIGS. 9 and 10, where yet another embodiment for a loader 120 is provided. In this embodiment, a handle 122 is provided, and first prong 130 and second prong 132 are provided extending outwardly therefrom, with general construction details as described above. However, in this embodiment a stiffener in the form of a bridge 140 is mechanically and metallurgically joined, such as by spot welding or brazing, to prongs 130 and 132. In an embodiment, the bridge 140 may have an overall width $W_{140}$ of about 11/32 inches. When used as a stiffener, such bridge 140 may be shaped to include first 142 and second 144 cutouts which have walls sized and shaped to match the peripheral shape 146 and 148, respectively, of prongs 130 and 132 at the point of attachment.

Figure 11:
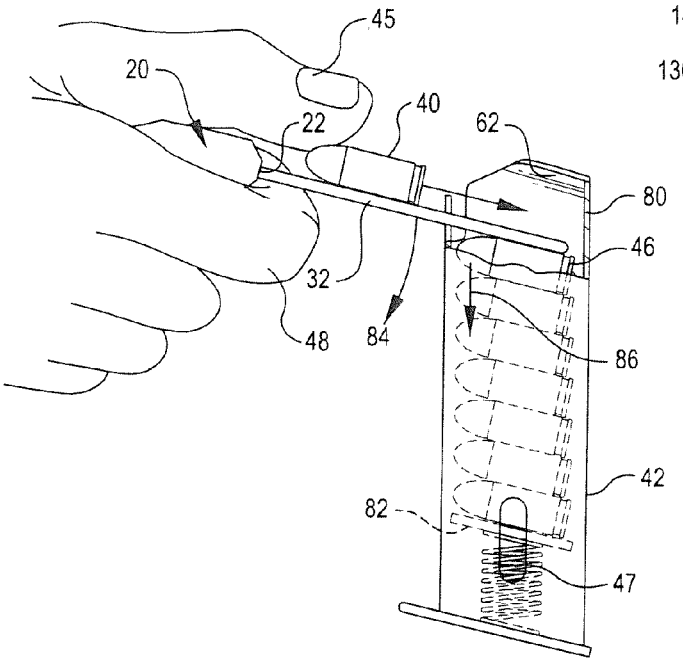
FIG. 11 is a partially cut away side view of a magazine that is being loaded using the loader design(s) provided herein.
Figure 12:
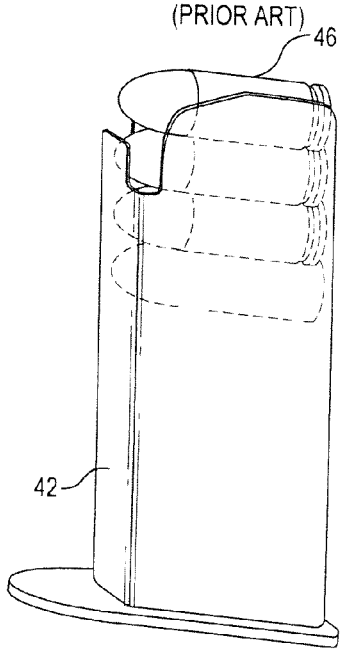
FIG. 12 (PRIOR ART)
FIG. 12 is a perspective view of yet another magazine that has been loaded using the loader design(s) provided herein.

As seen in FIGS. 11 and 2A, a loader 20 has at least one prong, here shown as prong 32, that has a curved lower engaging surface 60 for engaging and biasing a cartridge 46 in a magazine away from the upper open end 62 of the magazine 42. Similarly, the at least one prong, shown as prong 32, has a curved upper engaging surface 64 for accepting and cradling a cartridge 40 to be loaded in a magazine 42. In various embodiments, as seen in FIG. 2A, prongs such as prong 30 may be provided in cylindrical shape, i.e. round in cross-section. In various embodiments, the at least one prong 32 or the like is sized and shaped to enter the upper open end 62 of the magazine 42 when the magazine 42 is positioned for insertion of a cartridge 40.

Figure 8A:
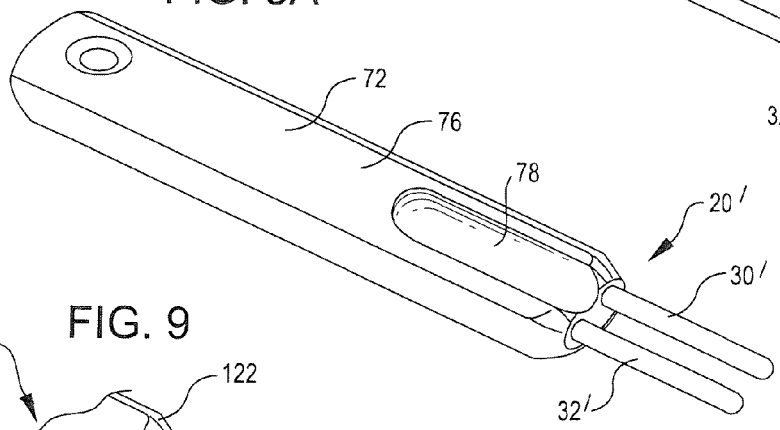
FIG. 8A is a reverse side view of another embodiment for a magazine loader, as initially shown in FIG. 1A, in which are pair of short, spaced apart, outwardly extending prongs is illustrated, and in which a groove is provided for providing an initial position for setting a cartridge to be loaded.

As seen in FIG. 1A, an obverse side 70 of a handle 72 for an embodiment for a magazine loader is provided, in which handle 72 is provided with a depressed groove or first cradle portion 74 that provides an initial location for setting a cartridge to be loaded. Similarly, FIG. 8A shows a view of a reverse side 76 of a handle 72 of embodiment for a magazine loader, as initially shown in FIG. 1A, in which a depressed groove or second cradle portion 78 is provided for providing an initial position for setting a cartridge to be loaded.

Figure 5:
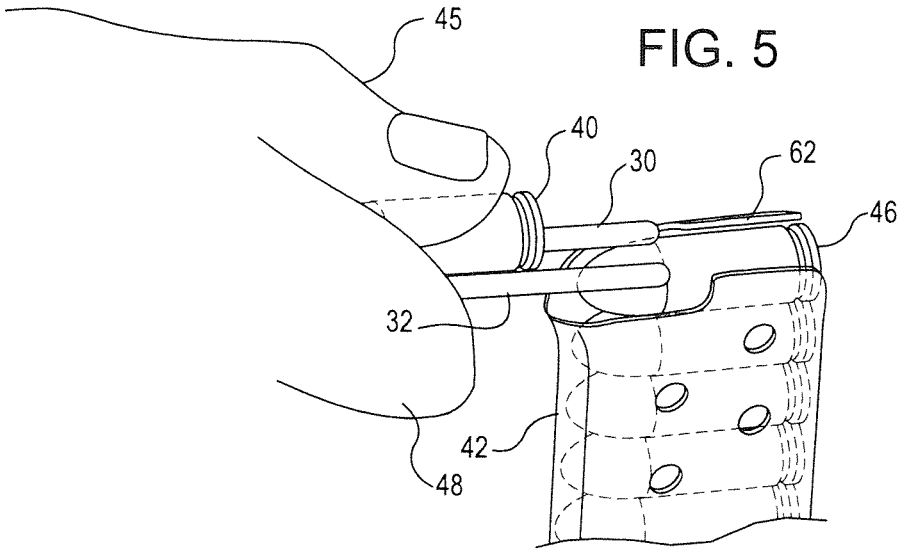
FIG. 5 is a perspective view, showing the lower engaging surfaces of the outwardly extending prongs of a magazine loader pressing down on a cartridge already in a magazine to urge the cartridge down against an upwardly biasing means in the magazine, so that space can be created in the magazine for the additional cartridge shown on the upper engaging surfaces of the outwardly extending prongs.
Figure 6:
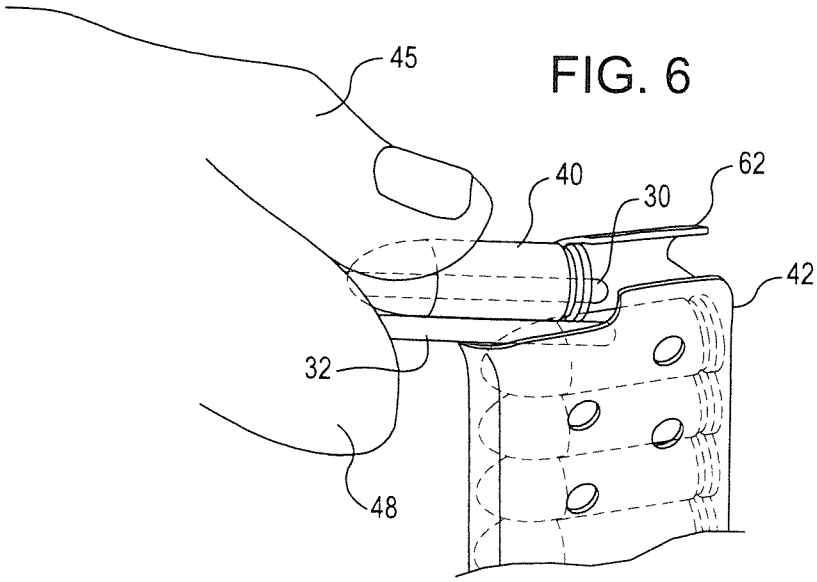
FIG. 6 is a perspective view, similar to that just shown in FIG. 5, now showing how a user's thumb may be used to urge a cartridge into a magazine, once the downward pressure exerted by the prongs of the loader have created space for the additional cartridge within the magazine.
Figure 7:
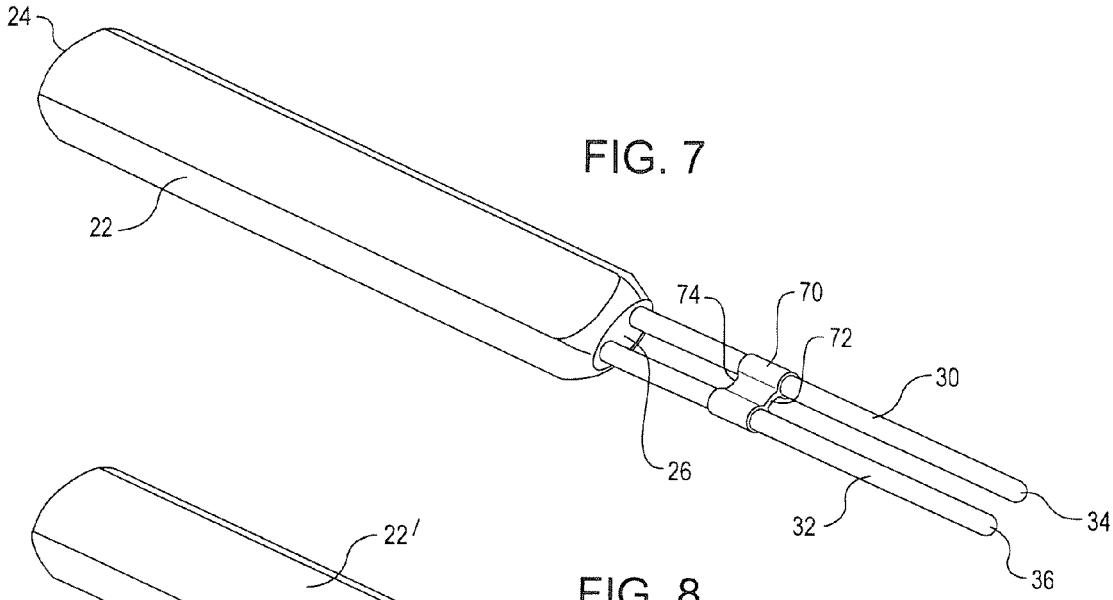
FIG. 7 is a perspective view of an embodiment for a magazine loader, as provided in FIG. 1 above, but now showing in further detail a pair of outwardly extending prongs, and the use of a smoothly contoured stiffening member between the prongs.

A simple method of loading cartridges 40 in to a gun magazine 42, is provided using loaders 20 or 20'. As seen in FIG. 11, a gun magazine 42 having containment walls 80 and an upper open end 62 for securely holding a plurality of cartridges 46 against upward biasing means such as spring 47 is provided. The magazine 42 is configured to urge cartridges 46 contained in the magazine (or a lower biased end 82, if the magazine 42 is empty), toward the upper open end 62. The method includes providing a loader 20, where the loader 20 has a handle 22 and at least one cartridge 46 engaging prong 32 extending outward from the handle 22. The cartridge engaging prongs (30 and 32) have upper engaging surfaces 64 for cradling a cartridge 40 to be inserted into the magazine 42, and a lower engaging surfaces 60 adapted to exert downward force in the direction of reference arrows 84 and 86 on a cartridge 46 in the magazine 42. Cartridge 40 to be loaded in the magazine 42 is provided. The cartridge 40 to be loaded in the magazine 42 is provided in a loading position as seen in FIGS. 5 and 11 on the upper engaging surfaces 64, and the cartridge 40 is manually securing such as by thumb 45 at the loading position. The lower engaging surfaces 60 are engaged with either a cartridge 46 in the magazine, or with the lower biased end 82 of the magazine 42, and downward force as indicated by reference arrows 84 is exerted to create space between the upper open end 62 and the at least one cartridge engaging prong 32, sufficient for the magazine 42 to accept the cartridge 40 to be loaded. Then, the cartridge 40 to be loaded is slid along the least one cartridge engaging prong 32, for example using prongs 30 and 32, until the cartridge 40 to be loaded is placed into the said magazine 42. Then, the loader 20 is removed from the magazine 42. The above procedure may be repeated for each cartridge 40 to be loaded. As noted above, the use of at least one cartridge engaging prong may be effectively accomplished using a pair of prongs.

Figure 13:
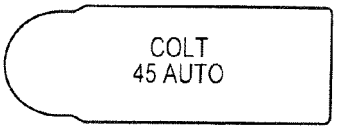
FIG. 13 (PRIOR ART)
FIG. 13 provides a photographic view of the base of an existing prior art magazine that may be loaded with cartridges using the magazine loader design(s) described herein.
Figure 14:
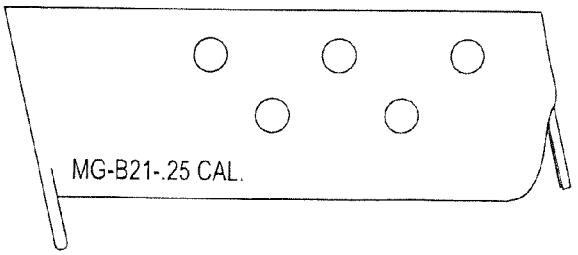
FIG. 14 (PRIOR ART)
FIG. 14 provides a view of the side of an existing prior art magazine that may be loaded with cartridges using the magazine loader design(s) described herein.

FIGS. 13 and 14 provide examples of a prior art magazines, such as a Colt 45 automatic, and a 25 mm caliber handgun magazine, which may be loaded using the gun magazine loader(s) described herein.

In so far as is presently known by the inventor hereof, the devices disclosed herein are the only devices currently available which are capable of loading all commonly encountered cartridges used in automatic pistols, and in some semi-automatic long guns. Further, the devices disclosed may be used "one-handed" whether by a single hand of an able bodied individual, or by a single available hand in the case of those users who are missing, or are without normal use, of an opposing hand.

In the foregoing description, for purposes of explanation, numerous details have been set forth in order to provide a thorough understanding of the disclosed exemplary embodiments for the design of a magazine loader for firearms. However, certain of the described details may not be required in order to provide useful embodiments, or to practice a selected or other disclosed embodiments. Further, for descriptive purposes, various relative terms may be used. Terms that are relative only to a point of reference are not meant to be interpreted as absolute limitations, but are instead included in the foregoing description to facilitate understanding of the various aspects of the disclosed embodiments. And, various actions or activities in any method described herein may have been described as multiple discrete activities, in turn, in a manner that is most helpful in understanding the present invention. However, the order of description should not be construed as to imply that such activities are necessarily order dependent. In particular, certain operations may not necessarily need to be performed precisely in the order of presentation. And, in different embodiments of the invention, one or more activities may be performed simultaneously, or eliminated in part or in whole while other activities may be added. Also, the reader will note that the phrase "in an embodiment" or "in one embodiment" has been used repeatedly. This phrase generally does not refer to the same embodiment; however, it may. Finally, the terms "comprising", "having" and "including" should be considered synonymous, unless the context dictates otherwise.

From the foregoing, it can be understood by persons skilled in the art that a novel magazine loader for firearms has been described herein. Although only certain specific embodiments of the present invention have been shown and described, there is no intent to limit this invention by these embodiments. Rather, the invention is to be defined by the appended claims and their equivalents when taken in combination with the description.

Importantly, the aspects and embodiments described and claimed herein may be modified from those shown without materially departing from the novel teachings and advantages provided, and may be embodied in other specific forms without departing from the spirit or essential characteristics thereof. Therefore, the embodiments presented herein are to be considered in all respects as illustrative and not restrictive or limiting. As such, this disclosure is intended to cover the structures described herein and not only structural equivalents thereof, but also equivalent structures. Numerous modifications and variations are possible in light of the above teachings. Therefore, the protection afforded to this invention should be limited only by the claims set forth herein, and the legal equivalents thereof.

I claim:

1. An apparatus configured for loading firearm cartridges into a magazine having an upper open end and a biasing device for urging a cartridge toward the upper open end, and sized to receive a specific caliber of cartridge selected from the range of about 45 caliber to about 25 caliber, said apparatus comprising:

a handle having a depressed cradle portion therein that is sized and shaped to accept cartridges to be loaded in the magazine; and first and second prongs:

extending outwardly an overall length $L_0$ from said handle to first and second distal ends, respectively, said length $L_0$ being from about one inch to about two inches;

spaced apart at a distance to engage cartridges having a caliber from about 45 caliber to about 25 caliber; and spaced closely enough together to pass through the upper open end of the magazine in a side by side configuration, for biasing a cartridge in said magazine away from said upper open end.

2. The apparatus as set forth in claim 1, wherein said first and second prongs include curved lower engaging surfaces for engaging and biasing cartridges in said magazine away from said upper open end.

3. The apparatus as set forth in claim 1, or in claim 2, wherein said first and second prongs include curved upper engaging surfaces for accepting and cradling a cartridge to be loaded in said magazine.

4. The apparatus as set forth in claim 3, wherein said first prong or said second prong is cylindrical.

5. The apparatus as set forth in claim 4, wherein said first prong or said second prong is about 3/32 inches in diameter.

6. The apparatus as set forth in claim 1, wherein said first and second prongs are sufficiently stiff to resist bending when urged against a cartridge held in said magazine by said biasing device of said magazine.

7. The apparatus as set forth in claim 6, wherein said first and second prongs comprise tempered steel.

8. The apparatus as set forth in claim 1, or in claim 6, further comprising a stiffener secured to and between said first and said second prongs.

9. The apparatus as set forth in claim 8, wherein said stiffener is spaced apart from said handle.

10. The apparatus as set forth in claim 1, wherein said first and second prong further comprise an embedded length LE, said embedded length located in said handle.

11. An apparatus configured for loading firearm cartridges into a magazine having an upper open end and a biasing device for urging a cartridge toward the upper open end, and sized to receive a specific caliber of cartridge selected from the range of about 45 caliber to about 25 caliber, said apparatus comprising:

a handle having a depressed cradle portion therein that is sized and shaped to accept cartridges to be loaded in the magazine;

first and second prongs extending outwardly an overall length $L_0$ from said handle, said length $L_0$ being from about one inch to about two inches, each of said first and second prongs having a distal end, said first and second prongs:

spaced apart at a distance to engage cartridges having a caliber from about 45 caliber to about 25 caliber;

spaced closely enough together to pass through the upper open end of the magazine in a side by side configuration, for biasing a cartridge in said magazine away from said upper open end; and a bridge portion joining said first and second prongs.

12. The apparatus as set forth in claim 11, wherein said first and second prongs each comprise a curved lower engaging surface for engaging and biasing a cartridge in said magazine away from said upper open end.

13. The apparatus as set forth in claim 11, wherein said first and second prongs each comprise a curved upper engaging surfaces for accepting and cradling a cartridge to be loaded in said magazine.

14. The apparatus as set forth in claim 11, wherein said first and second prongs are sized and shaped to enter said upper open end of the magazine when the magazine is positioned for insertion of a cartridge.

15. The apparatus as set forth in claim 1, or in claim 11, wherein the depressed cradle portion in included on an obverse side of said handle.

16. The apparatus as set forth in claim 2, or in claim 11, wherein said handle comprises a reverse side, and wherein said reverse side further comprises a depressed second cradle portion therein sized and shaped for accepting cartridges to be loaded in said magazine.

17. The apparatus as set forth in claim 11, wherein said first prong or said second prong is about 3/32 inches in diameter.

18. A method for loading cartridges in to a gun magazine, said gun magazine having containment walls and an upper open end for securely holding a plurality of cartridges against an biasing means in the magazine that is configured to urge cartridges contained in the magazine, or a lower biased end of the magazine, toward said upper open end, said method comprising:

(a) providing a loader, said loader having a handle and a pair of cartridge engaging prongs extending outward from said handle, said cartridge engaging prongs having upper engaging surfaces for cradling a cartridge to be inserted into the magazine, and lower engaging surfaces adapted to exert force on a cartridge in the magazine;

(b) providing a cartridge to be loaded in the magazine;

(c) placing the cartridge to be loaded in the magazine in a loading position on the upper engaging surfaces, and manually securing said cartridge to be loaded in said loading position;

(d) engaging said lower engaging surfaces with either a cartridge in said magazine, or with the lower biased end of the magazine, and exerting downward force to create space between said upper open end and said pair of cartridge engaging prongs sufficient to accept said cartridge to be loaded; and (e) sliding said cartridge to be loaded along said pair of cartridge engaging prongs until the cartridge to be loaded is placed in said magazine.

19. The method as set forth in claim 18, wherein each of said pair of cartridge engaging prongs comprises a stiff cylindrical member.

20. The method as set forth in claim 18, wherein said loader further comprises a stiffener located between the prongs in said pair of cartridge engaging prongs, said stiffener secured to and between said prongs, said stiffener adapted to substantially prevent spacing between prongs in said pair of cartridge engaging prongs from increasing during use.

21. An apparatus for loading firearm cartridges into a magazine having an upper open end and a biasing device for urging a cartridge toward the upper open end, and sized to receive a specific caliber of cartridge selected from the range of about 45 caliber to about 25 caliber, said apparatus comprising:

a handle, said handle comprising a first cradle for positioning a cartridge to be loaded in a magazine;

first and second cylindrical prongs, said first and second cylindrical prongs (a) comprised of tempered steel, (b) extending outwardly from said handle an overall length $L_0$ to first and second distal ends, respectively, said length $L_0$ being from about one inch to about two inches, and (c) having a diameter of about 3/32 of an inch; and said first and second prongs (a) spaced apart at a distance to engage cartridges having a caliber from about 45 caliber to about 25 caliber, and (b) spaced closely enough together to pass through the upper open end of the magazine in a side by side configuration, for biasing a cartridge in said magazine away from said upper open end.

* * * * *